United States Patent [19]

Schulze-Beckinghausen

[11] 4,192,206

[45] Mar. 11, 1980

[54] APPARATUS FOR ROTATING A TUBULAR MEMBER

[75] Inventor: Jörg Schulze-Beckinghausen, Garbsen, Fed. Rep. of Germany

[73] Assignee: Weatherford Lamb, Inc., Houston, Tex.

[21] Appl. No.: 913,256

[22] Filed: Jun. 6, 1978

[30] Foreign Application Priority Data

Jun. 11, 1977 [DE] Fed. Rep. of Germany ..... 2726472

[51] Int. Cl.[2] ..... B25B 17/00

[52] U.S. Cl. ..... 81/57.18

[58] Field of Search ..... 81/57.11, 57.12, 57.13, 81/57.14, 57.18, 57.20

[56] References Cited

U.S. PATENT DOCUMENTS

| | | | |
|---|---|---|---|
| 2,650,070 | 8/1953 | Lundeen | 81/57.18 |
| 2,703,221 | 3/1955 | Gardner | 81/57.18 |
| 2,879,680 | 3/1959 | Beeman et al. | 81/57.18 |
| 3,875,826 | 4/1975 | Dreyfuss et al. | 81/57.18 |
| 3,892,140 | 7/1975 | Fox et al. | 74/224 |
| 3,906,820 | 9/1975 | Hauk | 81/57.17 |
| 4,084,453 | 4/1978 | Eckel | 81/57.18 |

*Primary Examiner*—James L. Jones, Jr.

*Attorney, Agent, or Firm*—Fulbright & Jaworski

[57] ABSTRACT

An apparatus for rotating a tubular member. The apparatus has a housing with a recess for receiving the tubular member; a latch for closing off the recess; an operating means for the latch; a gear rim; discs within the housing to guide and retain the gear rim; a power means for driving the gear rim; and a crescent-shaped carrier member within the gear rim having means for contacting and gripping the tubular member. Either forward or reverse rotation of the gear rim results in the gripping of the tubular member and the imparting of torsion to the tubular member.

8 Claims, 6 Drawing Figures

APPARATUS FOR ROTATING A TUBULAR MEMBER

BACKGROUND OF THE INVENTION

1. Field of the Invention

The present invention relates to the field of apparatuses and methods for imparting torsion to a tubular member. In the drilling industry such devices are called "tongs" and they are used to rotate drill pipe, tubing, and casing.

2. Description of the Prior Art

The applicant deems the following prior art material to this application and it is the closest prior art of which the applicant is aware: U.S. Pat. No. 3,892,140; and U.S. Pat. No. 3,906,820. The rotary drive apparatus of U.S. Pat. No. 3,892,140 employs a chain to impart torsion to a tubular member. It does not exhibit the unique features of the present invention nor is it capable of functioning with the efficiency and flexibility of the present invention. The subject of U.S. Pat. No. 3,906,820 is an apparatus and method for spinning pipe which does not secure a tubular member; which does not protect a tubular member; which does not protect a tubular member from elastic deformation; and which does not provide efficient screwing and unscrewing of a tubular member.

The prior art apparatuses employ cams with very flat curvatures to convert peripheral forces of a drive means into the requisite gripping or clamping force. In order to hold or to rotate a tubular member, these forces must be of a very high magnitude. This often results in the penetration of the blades of the device into the tubular member. Efforts to then release the blades result in a rotation in an undesired opposite direction. These large forces may also result in damage to the apparatus itself, such as undesired expansion or deformation.

The magnitude of the gripping and clamping forces can be reduced by employing cams with greater curvature rather than flat curvature cams. But the use of greater curvature cams has resulted in contact forces too low to initiate an unscrewing operation. Prior art apparatuses have overcome this disadvantage in an inefficient and makeshift way by accomplishing an unscrewing operation in at least two steps: (1) using flat curvature cams to initiate unscrewing and (2) refitting the apparatus with greater curvature cams that would finish the unscrewing operation without the undesired results of tubular member penetration or apparatus deformation.

SUMMARY OF THE INVENTION

This invention provides a novel and efficient means for holding and rotating a tubular member which overcomes the disadvantages of prior art apparatuses in a unique way. The apparatus of the present invention has a housing with an opening for receiving a tubular member; a latch for closing off the opening; a power means for operating the latch; a gear rim rotatably mounted in gear rim rollers mounted on guide discs within the housing; a means for driving the gear rim including a power means and a gearing means; a crescent-shaped carrier member rotatably mounted within the gear rim; lever arms pivotally mounted to the crescent-shaped carrier member; guide rollers rotatably mounted to the lever arms; gripping jaws pivotally mounted to the lever arms at a point between the guide rollers and the point where the lever arms are mounted to the carrier member; and gripping elements formed of one face of the gripping jaws. The housing, the guide discs, and the gear rim have a radially recessed opening that permits the tong to be placed around the casing. The latch closes off this opening during operation of the apparatus.

The present invention overcomes the disadvantages and problems associated with prior art apparatuses. Lever means are provided between the gripping jaws and the cams. Three surface faces are provided on each cam: a clamping face, a holding face, and a centering face. The holding face is a circular arc oriented concentrically to the axis of the apparatus and the axis of the tubular member engaged by the apparatus. The centering face is not so concentrically oriented and it slopes away from the holding face to the radially recessed opening of the gear rim. The clamping face also is not concentrically oriented in the manner of the holding face and the slope of the clamping face away from the holding face is more pronounced than the slope of the centering face. The clamping face slopes away from the holding face to the interior wall of the gear rim.

The provision of these various cam faces results in numerous advantages. The gripping jaws can be readily freed from a tubular member after both a screwing and an unscrewing operation. The forces prevailing between the cams and the guide rollers that move along the cam surfaces is minimized so that neither the tubular member nor the apparatus is subjected to loads which would cause deformation. The slope of the clamping face makes possible a rapid increase in the gripping force; permits the gripping jaws to engage the tubular member in a virtually radial orientation; and suppresses the development of radial forces which would deform the apparatus or force it open. The gripping jaw elements traverse minimal distances on the exterior surface of the tubular member, further reducing the risk of tubular member deformation. Use of the centering face permits adjustment of the gripping jaws into centering position by a rotation of the gear rim. The jaws keep to the tubular member, although there is no driving contact therewith, and the tubular member while centered remains movable to a minor degree.

Since one gripping jaw can serve as a reaction element for the other gripping jaw, contact forces can be advantageously increased. The lever means are provided in the simple form of one-armed levers that are pivoted to the outer extremities of the carrier member. A guide roller is mounted on the end of each lever arm which roller moves along the various faces of the appropriate cam. The cams are axially staggered so that each guide roller can engage only one of the cams. The cams are disposed in symetrically opposite relation and they engage the guide rollers of the lever means in such a way that the guide roller of one lever means moves on the holding face and the guide roller of the opposite lever arm thereto necessarily moves on the clamping face. This makes possible the unilateral application of gripping force. The force of reaction is applied as backup force by the opposite gripping jaw and associated lever arm. This results in a substantially radial gripping force.

It is, therefore, an object of the present invention to provide an apparatus for rotating a tubular member having a housing with a radially recessed opening for receiving the tubular member, a latch mounted to the housing for closing off the recess, a power means for operating the latch, guide discs mounted within the housing, rollers mounted on the guide discs, a gear rim rotatably mounted on the rollers, a means for driving the gear rim including a power means and a gearing means between the power means and the gear rim, a crescent-shaped carrier member rotatably mounted within the gear rim, lever arms pivotally mounted to the carrier member, guide rollers rotatably mounted to the lever arms, gripping jaws pivotally mounted to the lever arms, gripping elements formed of one face of the gripping jaws, and cams mounted within the gear rim.

A further object of the present invention is the provision of such an apparatus wherein there are two symetrically opposed axially staggered cams.

Still a further object of the present invention is the provision of such an apparatus wherein each cam has formed of its interior wall a plurality of faces, including a clamping face, a holding face, and a centering face.

Yet another object of the present invention is the provision of such an apparatus wherein there are two lever arms and each lever arm has a gripping jaw pivotally mounted to it at a point between the point of mounting of the guide roller and the point of mounting of the lever arm to the carrier member.

Another object of the present invention is the provision of such an apparatus wherein the holding face is curved circularly and is concentrically oriented to the axis of the apparatus; the centering face is located on one side of the holding face and extends from the holding face to the edge of the radially recessed opening; and the clamping face is located on the other side of the holding face and extends from the holding face to the interior edge of the gear rim.

Another object of the present invention is the provision of such an apparatus wherein the clamping face slopes steeply away from the holding face and the centering face slopes gently away from the holding face and neither the clamping face nor the centering face is oriented concentrically to the axis of the apparatus.

DESCRIPTION OF THE PREFERRED EMBODIMENT

Figure 1:
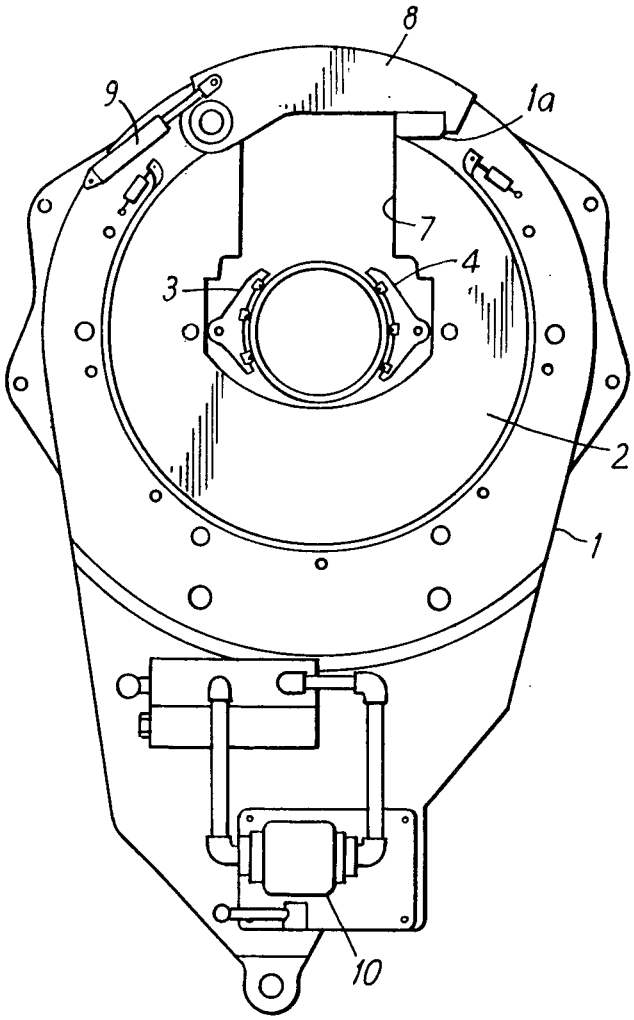
FIG. 1 is a plan view of the apparatus of the present invention.
Figure 2:
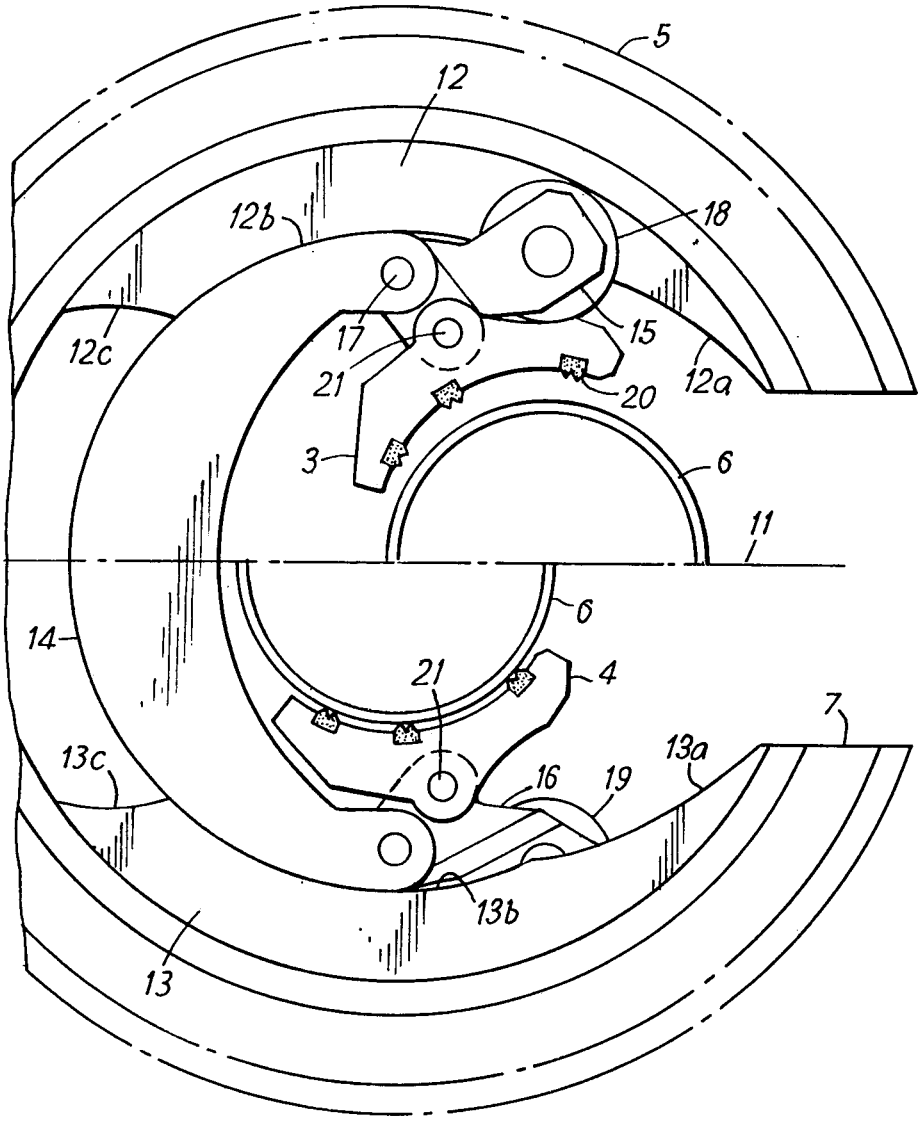
FIG. 2 is a plan view of the inner mechanism of the apparatus, the top half showing the mechanism in neutral position and the bottom half showing the mechanism in position about a tubular member.
Figure 6:
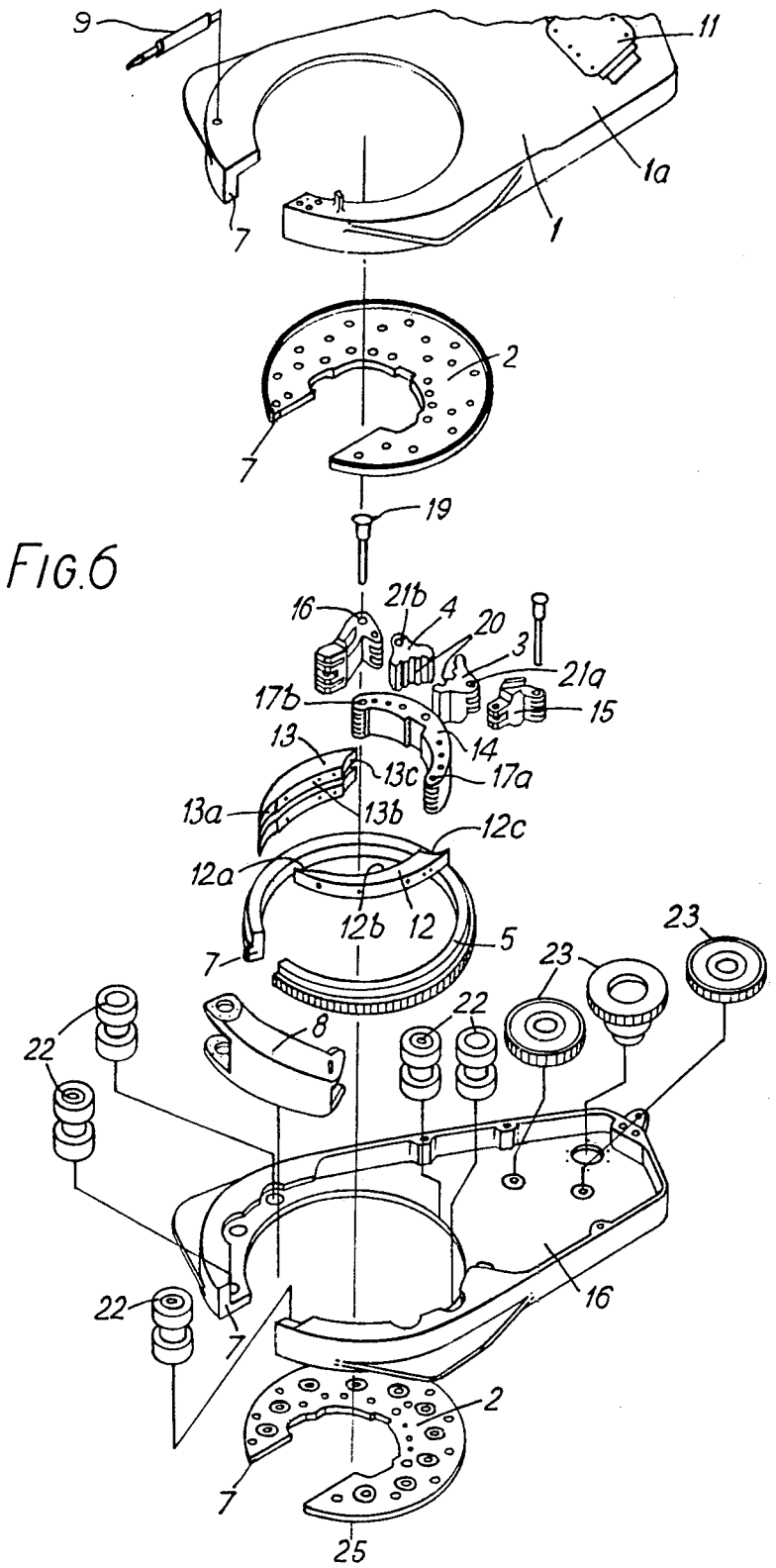
FIG. 6 is an exploded view of the apparatus of the present invention.

Referring now to FIGS. 1, 2, and 6 of the drawings, the preferred embodiment of the present invention is represented generally by the reference numeral 10. The apparatus 10 comprises a housing 1, a latch 8, a power means 9 for operating the latch, a gear rim 5 rotatably mounted in gear rim rollers 22 which are mounted on guide discs 2 within the housing 1, an apparatus power means 11 and gearing means 23 for driving the gear rim 5, a substantially crescent-shaped carrier member 14 rotatably mounted within the gear rim 5, lever arm 15 and lever arm 16 pivotally mounted to the crescent-shaped carrier member 14, guide roller 18 rotatably mounted to lever arm 15, guide roller 19 rotatably mounted to lever arm 16, gripping jaw 3 pivotally mounted to lever arm 15, gripping jaw 4 pivotally mounted to lever arm 15, gripping jaw 4 pivotally mounted to lever arm 16, and gripping elements 20 formed of the face of each of the gripping jaws 3 and 4.

The housing 1, the guide discs 2, and the gear rim 5 have a radially recessed opening 7 that permits the apparatus to be placed around a tubular member when the latch 8 is not secured in the closed position. The latch 8 is pivotally secured to the housing 1 at point 24. The power means 9 for operating latch 8 is secured to the housing 1 as shown in FIG. 1. The apparatus power means 11 is mounted on the housing 1 as shown in FIG. 1 and it drives the gearing means 23 which in turn drive the gear rim 5. The power means 9 is a conventional mechanical, hydraulic, or pneumatic power means. The apparatus power means 11 is a conventional hydraulic drive means. Line 25 represents the axis of the apparatus.

Figure 3:
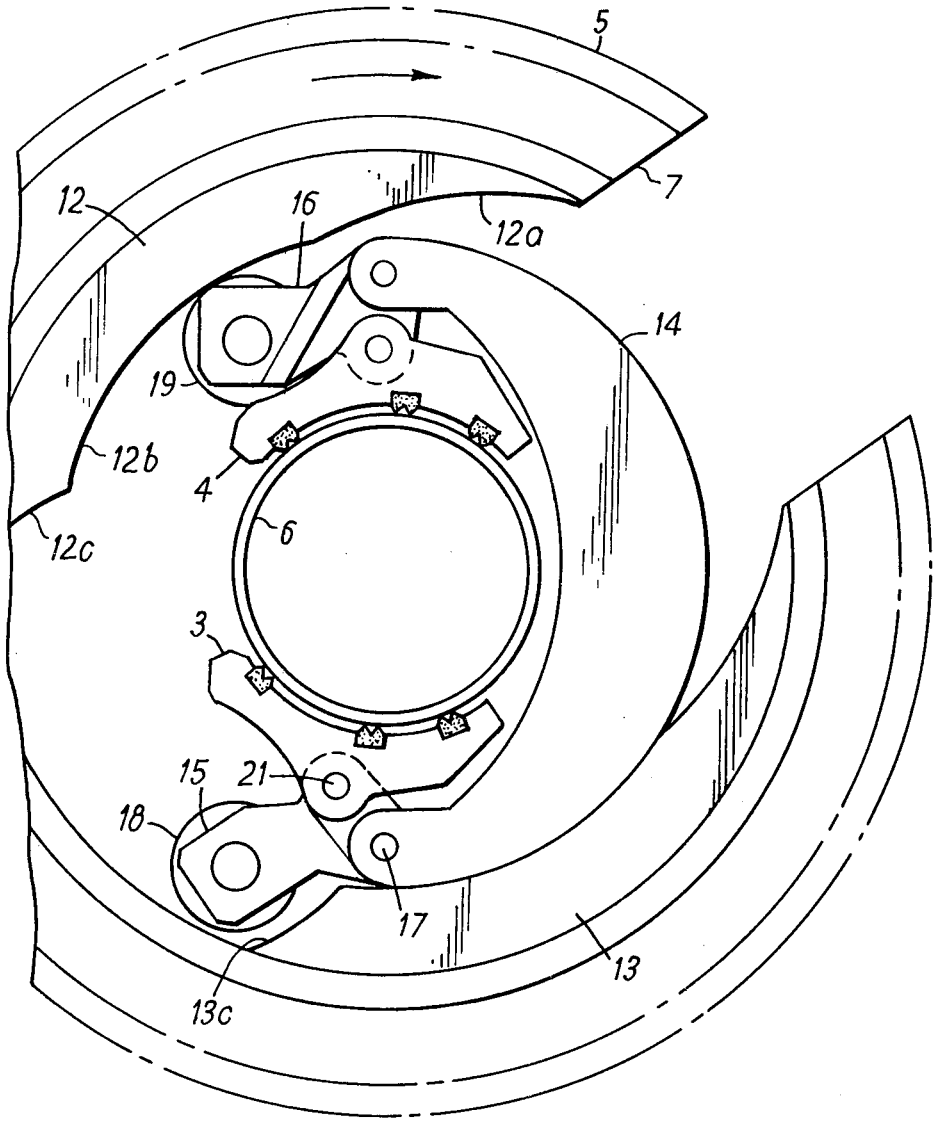
FIGS. 3, 4, and 5 are plan views similar to that of FIG. 2, each showing various stages of the operation of the apparatus of the present invention.
Figure 4:
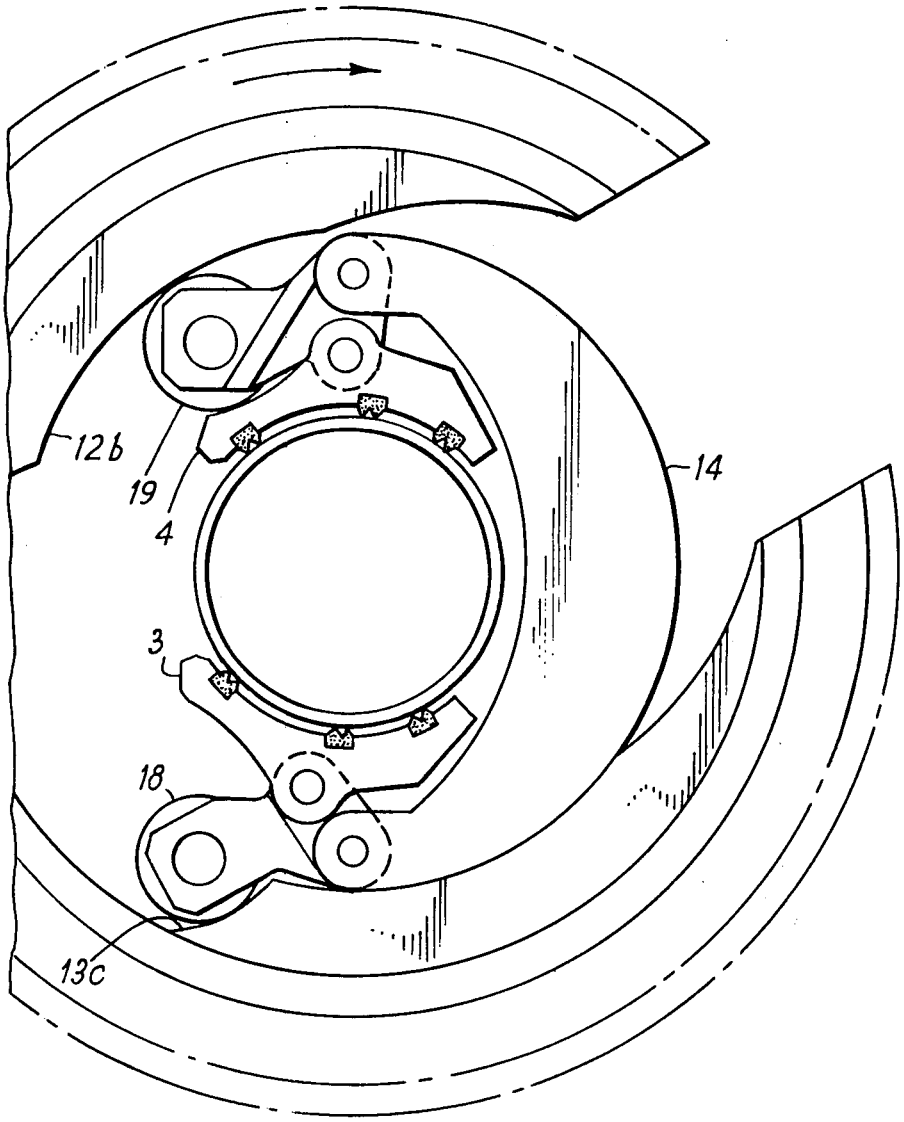
Figure 5:
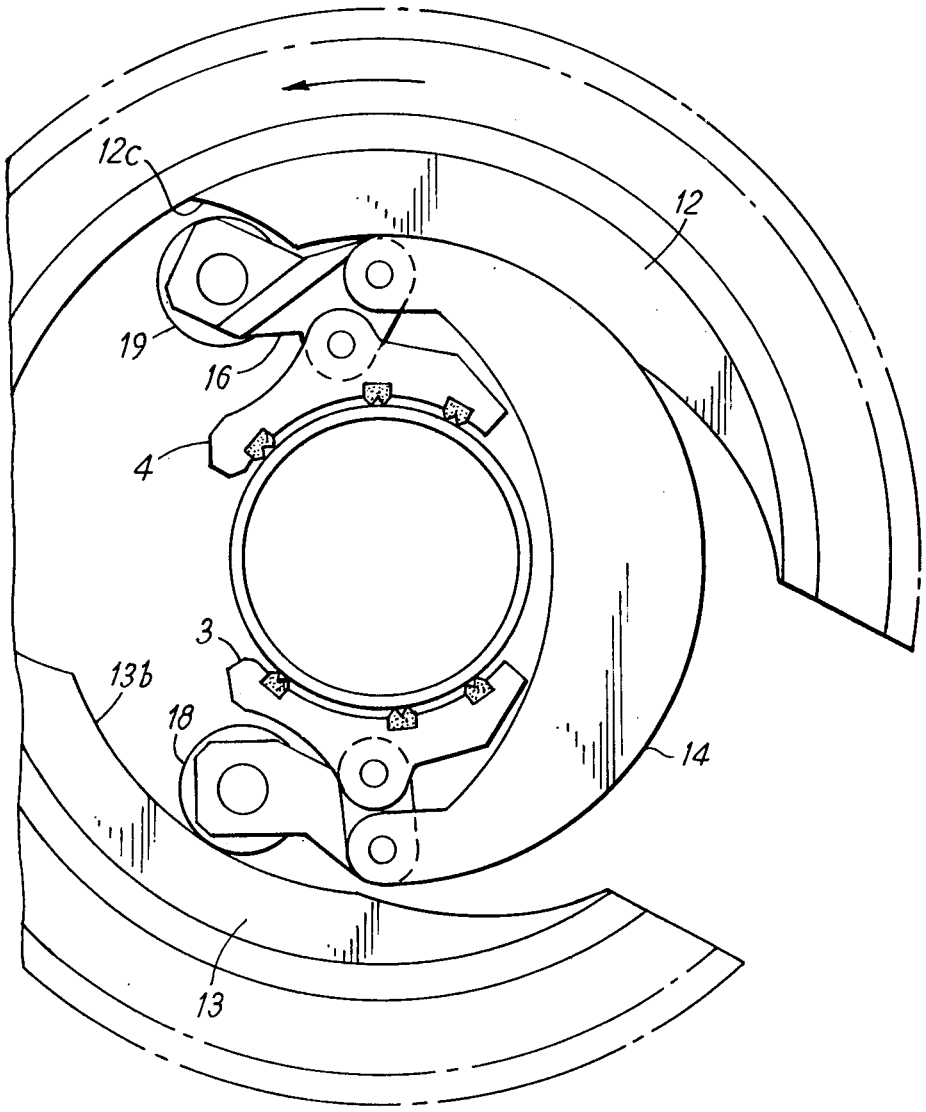

The gear rim 5 carries cams 12 and 13 which are disposed in symmetrically opposite relation to each other. Cam 12 is provided with a centering face 12*a*, a holding face 12*b*, and a clamping face 12*c*. Cam 13 is provided with a centering face 13*a*, a holding face 13*b*, and a clamping face 13*c*. Lever arm 15 is pivotally secured to carrier 14 at respective pivot points 17*a*. Lever arm 16 is pivotally secured to carrier 14 at respective pivot point 17*b*. Guide roller 18 is rotatably mounted to the free end 15*a* of lever arm 15; guide roller 19 is rotatably mounted to the free end 16*a* of lever arm 16. The gripping jaws 3 and 4 are pivotally mounted to their respective lever arms at pivot points 21*a* or 21*b* which are so disposed that they are between the respective guide roller and the respective pivot points 17*a* and 17*b*. As can be seen in FIGS. 3, 4, and 5, the gripping jaw 3 is functionally associated with cam 13 via guide roller 18 since guide roller 18 can only engage cam 13 and cannot engage cam 12. Gripping jaw 4 is functionally associated with cam 12 via guide roller 19 since guide roller 19 can only engage cam 12 and cannot engage cam 13. Axial staggering of cams 12 and 13 as shown in FIG. 2 makes possible this selective cam engagement. The holding faces 12*b* of cam 12 and 13*b* of cam 13 are circular arcs oriented concentrically to the axis of the apparatus. The centering faces 12*a* of cam 12 and 13*a* of cam 13 are not concentrically oriented in this way; they slope gently away from their respective holding faces 12*b* or 13*b* to the inner edge 7*a* of the radially recessed opening 7. The clamping faces 12*c* of cam 12 and 13*c* of cam 13 also are not concentrically oriented to the axis of the apparatus; they slope more abruptly away from their respective holding faces 12*b* or 13*b* than do the centering faces 12*a* and 13*a*.

The selective cam engagement and various modes of the apparatus are shown in FIGS. 2, 3, 4, and 5. In FIG. 3 guide roller 19 is engaging the holding face 12*b* of cam 12 thereby holding the tubular member 6 through the action of gripping jaw 4. The tubular member 6 had been moved into the center position by the engagement of the centering face 12*a* by the guide roller 19; the radially inward displacement of guide roller 19 until it reached the holding face 12*b* where it is retained as shown in FIG. 3; and the associated action of gripping jaw 4 of the tubular member 6 thereby moving it to the center position. The movement of the guide roller 19 along the centering face 12*a* and the holding face 12*b* is accomplished by moving the gear rim 5 in a clockwise direction as indicated by the arrow in FIG. 3. It should be noted that in FIG. 3 guide roller 18 has not yet contacted clamping face 13c.

The arrow in FIG. 4 indicates further clockwise rotation of gear rim 5 past the position of gear rim 5 in FIG. 3. This causes guide roller 19 to move a distance along holding face 12b. It also causes guide roller 18 to contact clamping face 13c thereby insuring that the apparatus is securely "clamped" to the tubular member 6 to be rotated. FIG. 4 clearly shows that cams 12 and 13 are always in such a relative disposition that one of the gripping jaws (jaw 4 in FIG. 4) is retained in centered position by one of the holding fares and thus serves as a reaction element that provides the back pressure or reaction force necessary for the clamping pressure of the opposite gripping jaw (jaw 3 in FIG. 4) to build up.

The arrow on the gear rim 5 in FIG. 5 indicates that the gear rim 5 has been reversed and rotated approximately five-sixths of a turn counterclockwise from its position in FIG. 4. In FIG. 5 guide roller 18 is now in contact with the holding face 13b of cam 13 while guide roller 19 is now in contact with the clamping face 12c of cam 12. This configuration again exhibits the reaction-element feature of the gripping jaws. In FIG. 5 gripping jaw 3 acts as a reaction element for gripping jaw 4 so that the tubular member 6 is secured in centered position and is rotatable by further turning of the gear rim 5.

FIGS. 2, 3, 4, 5, and 6 show that the clamping faces 12c of cam 12 and 13c of cam 13 are provided with an abrupt slope so that the necessary clamping or gripping force is realized with only minor peripheral movements of the gear rim 5 and with only extremely small peripheral movements of the gripping jaws 3 and 4 during each clamping or gripping operation. This feature is enhanced by the provision of lever arms 15 and 16.

What is claimed is:

1. An apparatus for rotating a tubular member, comprising, (a) a housing having a radially recessed opening for receiving the tubular member, said housing having a top member and a bottom member, (b) a latch for closing off the radially recessed opening during operation of the apparatus, said latch being pivotally secured to the housing on one side of the radially recessed opening, (c) a latch power means for actuating the latch connected to the latch, (d) a guide disc mounted within the housing, said guide disc having a radially recessed opening for receiving the tubular member corresponding to the radially recessed opening of the housing, (e) a plurality of gear rim rollers rotatably secured to the guide disc and to the housing, (f) a gear rim mounted so as to be movable on the gear rim rollers, said gear rim having an interior wall and a radially recessed opening for receiving the tubular member corresponding to the radially recessed openings of the housing and of the guide disc, (g) a gearing mechanism composed of a plurality of gears for transmitting power to the gear rim, said gearing mechanism being secured within the housing so as to intermesh with the gear rim, (h) a power drive means for driving the gearing mechanism and the gear rim, said power drive means being secured to the exterior of the housing, (i) a first and a second multifaceted cam mounted within the gear rim in axially staggered relation, (j) a substantially crescent-shaped carrier member mounted within the gear rim, and having a first end and a second end, said carrier member being rotatable within the gear rim and along the cams, (k) a first lever arm pivotally secured to the first end of the carrier member, (l) a second lever arm pivotally secured to the second end of the carrier member, (m) a first gripping jaw for gripping the tubular member, said jaw pivotally secured to the first lever arm, (n) a second gripping jaw for gripping the tubular member, said jaw pivotally secured to the second lever arm, (o) a first guide roller rotatably mounted to the first lever arm so that it moves on the faces of the first multi-faceted cam for actuating the first gripping jaw and mounted so that it cannot move on the faces of the second multi-faceted cam, (p) and a second guide roller rotatably mounted to the second lever arm so that it moves on the faces of the second multi-faceted cam for actuating the second gripping jaw and mounted so that it cannot move on the faces of the first multi-faceted cam.

2. The invention of claim 1 wherein each gripping jaw is mounted to its respective lever arm at a point between the point of the securing of the respective lever arm to the carrier member and the lever arm's respective guide roller.

3. The invention of claim 1 wherein a plurality of guide discs are provided, each such guide disc having a radially recessed opening corresponding to the radially recessed opening of the housing.

4. The invention of claim 1 wherein gripping elements are formed of the face of each gripping jaw.

5. The invention of claim 1 wherein the latch power means is a conventional non-electrical power means.

6. The invention of claim 1 wherein the power drive means is a conventional hydraulic power means.

7. The invention of claim 1 wherein the first and the second multi-faceted cams are disposed in substantially opposite relation, each of said cams having three faces formed on the surface thereof, a centering face, a holding face, and a clamping face, the holding face being shaped in the form of a circular arc oriented concentrically to the axis of the apparatus, the centering face sloping gently away from one end of the holding face to the edge of the radially recessed opening of the gear rim, and the clamping face sloping abruptly from the other end of holding face to the interior wall of the gear rim, said cams being axially staggered with respect to the gear rim and the axis of the apparatus and disposed symetrically with respect to the axis of the apparatus.

8. An apparatus for rotating a tubular member, comprising, (a) a housing having a radially recessed opening for receiving the tubular member, said housing having a top member and a bottom member, (b) a latch for closing off the radially recessed opening during operation of the apparatus, said latch being pivotally secured to the housing on one side of the radially recessed opening, (c) a non-electrical latch power means for operating the latch, said latch power means connected to one side of the latch, (d) two guide discs mounted within the housing, each of said guide discs having a radially recessed opening for receiving the tubular member corresponding to the radially recessed opening of the housing, (e) a plurality of gear rim rollers secured to the guide discs and to the housing, (f) a gear rim movably mounted on the gear rim rollers, said gear rim having a radially recessed opening for receiving the tubular member corresponding to and substantially aligned with the radially recessed openings of the housing and of the guide discs, said gear rim having an exterior wall and an interior wall, (g) a gearing mechanism for transmitting power to the gear rim comprised of a plurality of gears secured within the housing so as to intermesh with the gear rim, (h) an hydraulic power drive means for driving the gear rim through the gearing mechanism, said power drive means being secured to the housing, (i) a first and a second cam disposed in substantially opposite relation and axially staggered with respect to the axis of the apparatus, each such cam having a holding face, a centering face, and a clamping face, said holding face disposed between the other two faces and shaped in the form of a circular arc and oriented concentrically to the axis of the apparatus, said centering face sloping gently away from one end of the holding face to the inner edge of the radial recessed opening, and said clamping face sloping abruptly from the other end of the holding face to the interior wall of the gear rim, said cams being disposed substantially symmetrically with respect to the axis of the apparatus, (j) a substantially crescent-shaped carrier member rotatably mounted within the gear rim and cams, said carrier member having a first end and a second end, (k) a first lever arm pivotally secured to the first end of the carrier member, (l) a second lever arm pivotally secured to the second end of the carrier member, (m) a first guide roller rotatably mounted to the first lever arm and movable on the faces of the first cam for actuating the first gripping jaw, said first guide roller mounted so that it cannot move on the faces of the second cam, (n) a second guide roller rotatably mounted to the second lever arm and movable on the faces of the second cam for actuating the second gripping jaw, said second guide roller mounted so that it cannot move on the faces of the first cam.

(o) a first gripping jaw for gripping the tubular member pivotally secured to one end of the first lever arm at a point between the guide roller and the point of the securing of the lever arm to the carrier member, (p) a second gripping jaw for gripping the tubular member pivotally secured to one end of the second lever arm at a point between the guide roller and the point of the securing of the lever arm to the carrier member, (q) gripping elements formed of the surface of each gripping jaw.

* * * * *